US007621010B1

(12) United States Patent
Eltzroth

(10) Patent No.: US 7,621,010 B1
(45) Date of Patent: Nov. 24, 2009

(54) DENTAL CHAIR OVERLAY

(76) Inventor: Ruda R. Eltzroth, 2244 County Road 1A, Cotopaxi, CO (US) 81223

( * ) Notice: Subject to any disclaimer, the term of this patent is extended or adjusted under 35 U.S.C. 154(b) by 0 days.

(21) Appl. No.: 12/238,006

(22) Filed: Sep. 25, 2008

(51) Int. Cl.
*A47C 27/15* (2006.01)
*A47G 9/00* (2006.01)

(52) U.S. Cl. ..... 5/632; 5/419; 5/691; 297/219.1; 297/229; 297/452.26; 297/452.28

(58) Field of Classification Search ..... 5/632, 5/420, 417, 691, 636, 727, 419, 638; 297/219.1, 297/229, 452.26, 452.28, 393, 330
See application file for complete search history.

(56) References Cited

U.S. PATENT DOCUMENTS 4,128,272 A * 12/1978 Boyle ..... 297/284.3
4,424,599 A * 1/1984 Hannouche ..... 5/632
5,586,351 A * 12/1996 Ive ..... 5/655
5,630,239 A * 5/1997 Franzen, Jr. ..... 5/632
6,751,818 B2 * 6/2004 Troop ..... 5/636
6,935,685 B2 * 8/2005 Kassai et al. ..... 297/219.1
7,231,677 B1 * 6/2007 Reeves ..... 5/419
2003/0145387 A1 * 8/2003 Karafa et al. ..... 5/733

* cited by examiner

*Primary Examiner*—Alexander Grosz
(74) *Attorney, Agent, or Firm*—Mark G. Pannell; Hanes & Schutz, LLC

(57) ABSTRACT

A dental chair overlay is used for opening a patient's airway. The dental chair overlay has a body support and a head support. The body support has a superior end and dorsal and ventral surfaces. The distance between the dorsal and ventral surfaces define a thickness of the body support. The head support is attached to the superior end of the body support. The head support has dorsal and ventral surfaces. The distance between the dorsal and ventral surfaces define a thickness of the head support. The thickness of the body support is greater than the thickness of the head support, such that the airway of a patient lying on the dental chair overlay is urged open.

4 Claims, 2 Drawing Sheets

DENTAL CHAIR OVERLAY

BACKGROUND

Conventional dental chairs raise the head of the patient slightly compared to the patient's shoulders or maintain the patient's head in the same plane as the patient's shoulders. This causes the patient's chin to dip towards the patient's chest, which partially closes the patient's airway. Maintaining an open airway is important, especially in patients who are undergoing extensive dental care, such as oral surgery or sedation dentistry. Traditionally, there have been few adjuncts to aid the dental provider in this area. Additionally, dental patient chairs typically are uncomfortable, causing the patient to frequently move their bodies and therefore their heads, further compromising the maintenance of proper airway during care.

DETAILED DESCRIPTION

Figure 1:
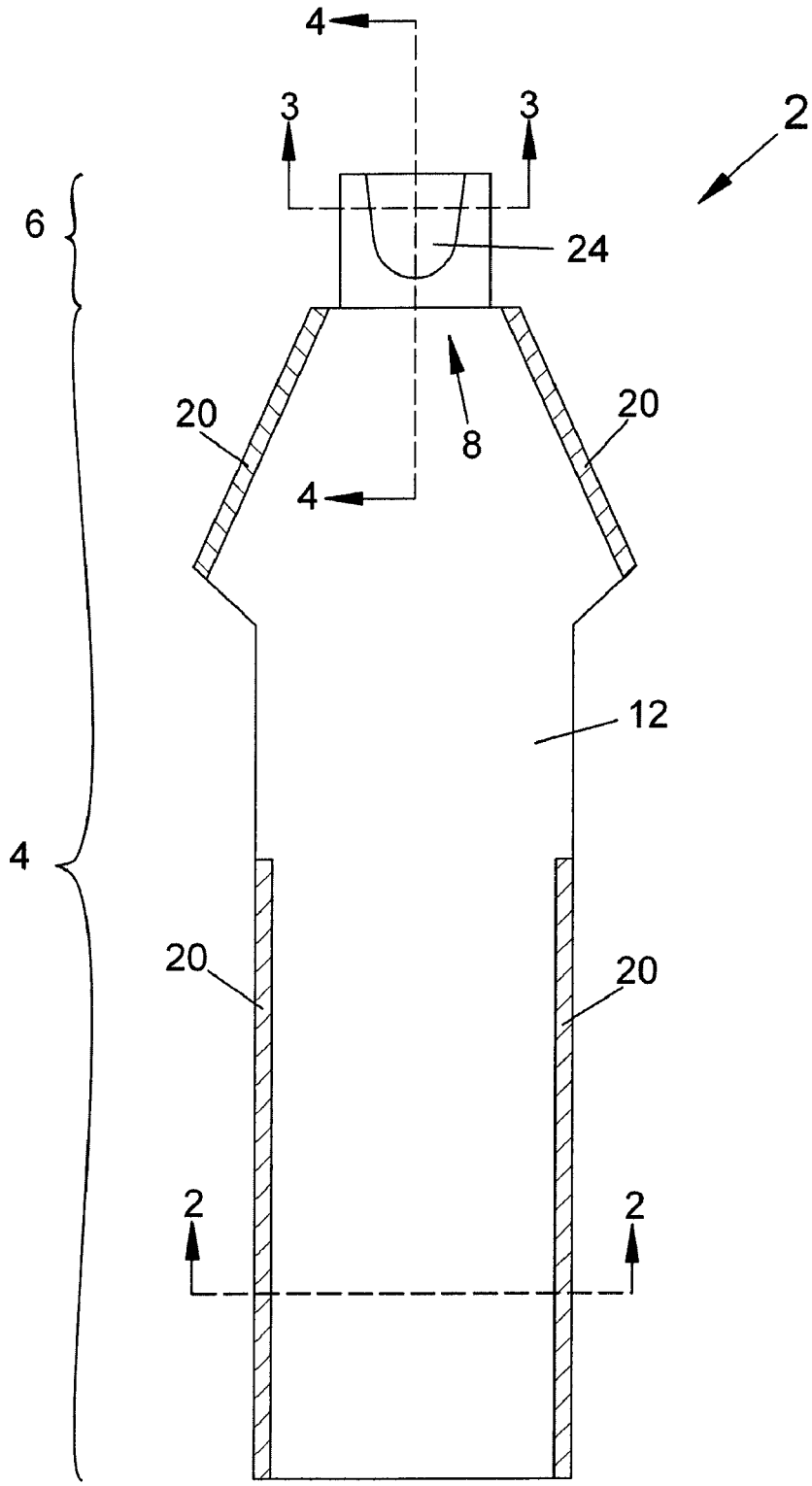
FIG. 1 is top elevation of an embodiment of the dental chair overlay of the present invention.

FIG. 1 illustrates one embodiment of a dental chair overlay 2. In use, dental chair overlay 2 is overlain on top of the original sitting surface of a dental chair. Dental chair overlay 2 includes a body support 4 and a head support 6.

Body support 4 is an elongated cushion for supporting a patient's body. In one embodiment, body support 4 has a pressure reducing, comfortable surface allowing extended treatment times with less patient movement. In one embodiment, the lower, inferior, portion of body support 4 is rectangular in shape while the upper, superior, portion of body support 4 is flared. Head support 6 is attached to the superior end 8 of body support 4.

Figure 2:
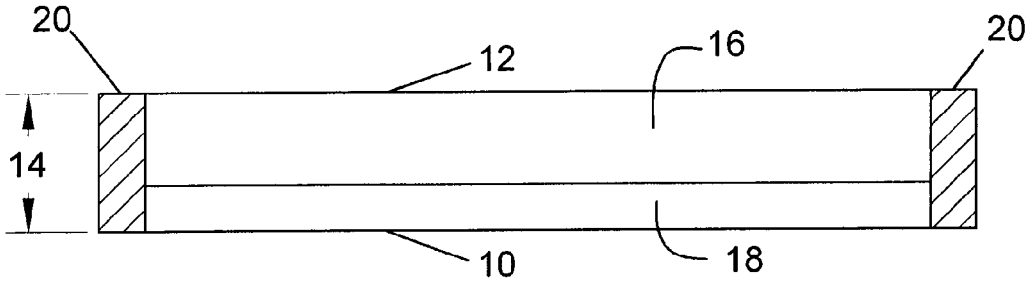
FIG. 2 is transverse cross-section of the body support of the dental chair overlay of FIG. 1.

FIG. 2 is a transverse cross-section of body support 4. Body support 4 has dorsal 10 and ventral 12 surfaces. The distance between dorsal 10 and ventral 12 surfaces defines a thickness 14 of body support 4.

In one embodiment, body support 4 includes first 16 and second 18 foam layers. Lateral sides 20 are also formed of foam. In one embodiment, first 16 and second 18 foam layers and lateral sides 20 are non-viscoelastic foam. In one embodiment, lateral sides 20 have an indentation load deflection (ILD) rating over 55 and a density over 3.0 pounds per cubic foot. The high ILD rating and density of lateral sides 20 provides resistance to patient lateral movements and positions the patient towards the longitudinal axis of the body support 4. In one embodiment, lateral sides 20 do not extend into the middle of dental chair overlay 2, maintaining flexibility for operation of the dental chair.

First foam layer 16 is disposed adjacent ventral surface 12 of body support 4. In one embodiment, first foam layer 16 is approximately two inches thick, has an ILD rating between 10 and 24, and has a density of between 2.8 and 4.5 pounds per cubic foot.

Second foam layer 18 is disposed between first foam layer 16 and dorsal surface 10 of body support 4. In one embodiment, second foam layer 18 is approximately one inch thick, has an ILD rating greater than the ILD rating of the first foam layer, between 25 and 35, and has a density less than the first foam layer, of between 1.6 and 3.0 pounds per cubic foot. First 16 and second 18 foam layers together enhanced patient comfort and pressure reduction.

Figure 3:
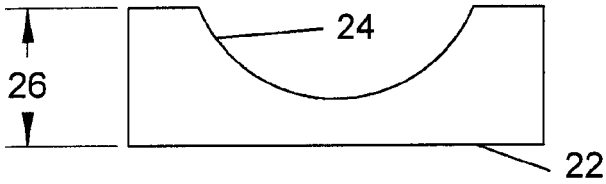
FIG. 3 is transverse cross-section of the head support of the dental chair overlay of FIG. 1.

FIG. 3 is a transverse cross-section of head support 6. Head support 6 also has dorsal 22 and ventral 24 surfaces. The distance between dorsal 22 and ventral 24 surfaces defines a thickness 26 of head support 6. In one embodiment, thickness 26 of head support 6 is non-uniform, greater laterally and lesser medially, to form a cupped surface for receiving the head of a patient. Thickness 14 of body support 4 is greater than thickness 26 of head support 6, at least in the center of head support 6.

Figure 4:
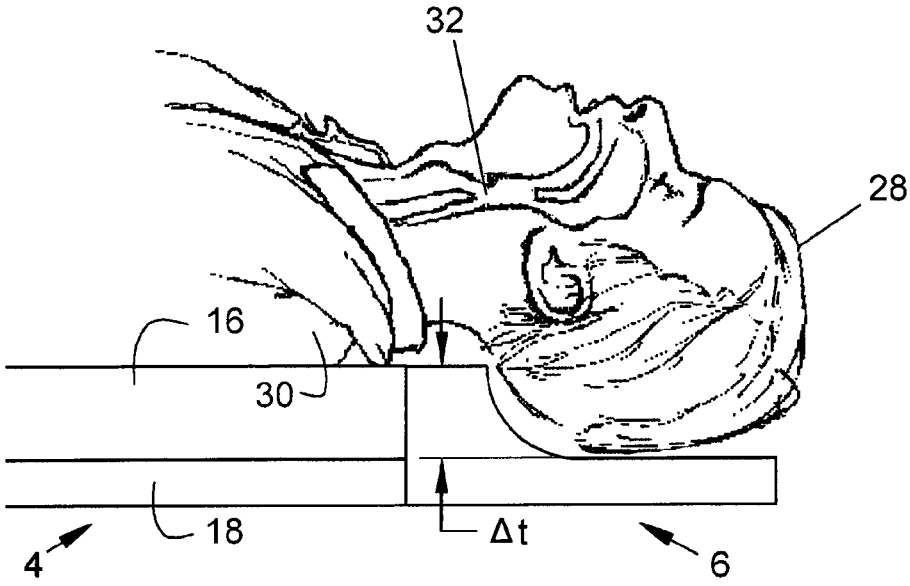
FIG. 4 is a longitudinal cross-section of the dental chair overlay, illustrating the patient's position when being used.

FIG. 4 is a longitudinal cross-section of dental chair overlay 2, illustrating the patient's position when in use. When in use overlain on a dental chair, ventral surface 24 of head support 6 is offset dorsally from ventral surface 12 of body support 4. When in use by a patient and overlain on a dental chair, the difference $\Delta t$ between thickness 14 and thickness 26 permits the patient's head 28 to offset dorsally from the patient's shoulders 30. This position urges open the patient's airway 32 to a greater extent than would have been achieved without dental chair overlay 2. As may be seen in FIG. 4, head support 6 is also greater inferiorly and lesser superiorly to support the patient's neck. Supporting the patient's neck also urges open the patient's airway 32.

In one embodiment, dental chair overlay 2 is provided with a cover to conceal and protect the foam layers. The cover is waterproof and disinfectable, with an anti-slip dorsal surface.

The foregoing description is only illustrative of the invention and not intended to be exhaustive or to limit the invention to the precise forms disclosed. Various alternatives and modifications can be devised by those skilled in the art without departing from the invention. Accordingly, the present invention embraces all such alternatives, modifications, and variances that fall within the scope of the appended claims.

What is claimed is:

1. A dental chair overlay comprising:

a body support having a superior end and dorsal and ventral surfaces, the distance between the dorsal and ventral surfaces defining a generally uniform thickness for the body support, the body support comprised of a material that provides resistance to patient lateral movements and positions a patient towards the longitudinal axis of the body support;

a head support attached to the superior end of the body support and having dorsal and ventral surfaces the distance between the dorsal and ventral surfaces defining a thickness of the head support, the head support being thicker at its lateral edges than in the region between the lateral edges, thereby forming a cupped surface for receiving the head of a patient, the head support being thicker at an area adjacent to the body support, than at an area further away from the area adjacent to the body support, thereby defining a means for supporting a patient's neck;

wherein the thickness of the body support is greater than the thickness of the head support, such that the airway of a patient lying on the dental chair overlay is urged open.

2. The dental chair overlay of claim 1 wherein the body support further includes:

a first foam layer disposed adjacent the ventral surface of the body support and having a first indentation load deflection (ILD) rating;

a second foam layer disposed between the first foam layer and the dorsal surface of the body support and having a second ILD rating greater than the first ILD rating.

3. The dental chair overlay of claim 2 wherein:

the first foam layer has a first density and the second foam layer has a second density less than the first foam density.

4. The dental chair overlay of claim 2 wherein the body support further includes lateral sides formed of foam having a third ILD rating greater than the first and second ILD ratings.

* * * * *